US008006956B2

(12) United States Patent
Payne

(10) Patent No.: US 8,006,956 B2
(45) Date of Patent: Aug. 30, 2011

(54) TARP LOADING STRUCTURE AND METHOD FOR USING SAME

(76) Inventor: Fred V. Payne, Fredonia, NY (US)

( * ) Notice: Subject to any disclaimer, the term of this patent is extended or adjusted under 35 U.S.C. 154(b) by 1221 days.

(21) Appl. No.: 11/182,157

(22) Filed: Jul. 14, 2005

(65) Prior Publication Data

US 2007/0013004 A1 Jan. 18, 2007

(51) Int. Cl.
*B66D 1/36* (2006.01)

(52) U.S. Cl. ..... 254/286; 254/324; 52/3; 212/166

(58) Field of Classification Search ..... 254/266, 254/286, 295, 323–325; 52/3; 212/166
See application file for complete search history.

(56) References Cited

U.S. PATENT DOCUMENTS

| | | | | |
|---|---|---|---|---|
| 209,519 | A | 10/1878 | Sanda | 5/86.1 |
| 2,529,948 | A | 11/1950 | Jones | 254/281 |
| 3,397,009 | A | 8/1968 | Landenberger | 296/98 |
| 3,614,154 | A | 10/1971 | Evans | 296/137 R |
| 3,941,363 | A | 3/1976 | Ogg | 269/100 |
| 4,236,859 | A | 12/1980 | Stearn et al. | 414/460 |
| 4,302,043 | A | 11/1981 | Dimmer et al. | 296/98 |
| 4,572,568 | A | 2/1986 | Kapp et al. | 296/39 R |
| 4,861,218 | A | 8/1989 | Lamer | 414/461 |
| 5,074,528 | A | 12/1991 | Long, Jr. | 254/285 |
| 5,111,554 | A | 5/1992 | Sweers | 24/16 R |
| 5,138,953 | A * | 8/1992 | Horcher et al. | 105/149.2 |
| 5,337,908 | A * | 8/1994 | Beck, Jr. | 212/312 |
| 5,427,356 | A * | 6/1995 | Krotov et al. | 254/324 |
| 5,564,232 | A | 10/1996 | Callaway | 5/4 |
| 5,692,534 | A | 12/1997 | Brumfield | 135/90 |
| 5,743,515 | A | 4/1998 | Wodell | 254/334 |
| 5,743,700 | A | 4/1998 | Wood, Jr. et al. | 414/498 |
| 5,769,105 | A | 6/1998 | Margol et al. | 135/90 |
| 5,772,183 | A | 6/1998 | Sears | 254/324 |
| 5,964,236 | A | 10/1999 | Berke | 135/87 |
| 6,003,929 | A | 12/1999 | Birdsell | 296/100.16 |
| 6,003,939 | A | 12/1999 | Nakai et al. | 297/216.13 |

(Continued)

FOREIGN PATENT DOCUMENTS

CA 2354381 1/2003

(Continued)

OTHER PUBLICATIONS

Load Protection: a Case Study in Ergonomics and Safety; W.S. Green et al; no date available.

*Primary Examiner* — Emmanuel M Marcelo
(74) *Attorney, Agent, or Firm* — The Bilicki Law Firm, P.C.

(57) ABSTRACT

A building structure for covering a large object with a cover comprising: multiple frames, each frame being part of a building structure); at least one motor suspended from at least one of said plurality of frames and connected to one or more spools; and an arm lifting structure suspended from the frame and comprising: at least two arms; a plurality of lifting connectors, each attached on one end to an arm on a first end and attached to one of the spools on a second end; and at least one fastening roller member mounted to each arm for temporarily securing the cover to the arms. Alternate embodiments of the building structure include laterally and/or longitudinally translating motors and/or guides for ensuring that the arms are raised and lowered straight up and down.

20 Claims, 14 Drawing Sheets

U.S. PATENT DOCUMENTS

| | | | | |
|---|---|---|---|---|
| 6,102,059 | A | 8/2000 | Miller | 135/87 |
| 6,203,472 | B1 | 3/2001 | McCaffrey et al. | 482/61 |
| 6,273,401 | B1 | 8/2001 | Payne | 254/266 |
| 6,464,208 | B1 | 10/2002 | Smith | 254/324 |
| 6,857,620 | B2 | 2/2005 | Payne | 254/324 |
| 2001/0037709 | A1 | 11/2001 | Kuchta et al. | 83/23 |
| 2001/0037710 | A1 | 11/2001 | Kuchta et al. | 83/84 |
| 2004/0046161 | A1* | 3/2004 | Payne | 254/266 |
| 2007/0013004 | A1* | 1/2007 | Payne | 257/368 |

FOREIGN PATENT DOCUMENTS

| | | |
|---|---|---|
| DE | 3546070 | 7/1987 |
| JP | 08150872 | 6/1996 |

* cited by examiner

TARP LOADING STRUCTURE AND METHOD FOR USING SAME

FIELD OF INVENTION

The present invention generally relates to an apparatus and method for covering large containers. More particularly, the invention relates to a structure for covering loaded trucks, rail cars, and the like with a tarp or related covering and a method for using same.

BRIEF DESCRIPTION OF THE DRAWINGS

FIG. 3*a* shows a top perspective view of one embodiment of arm lifting structure.

DETAILED DESCRIPTION OF EMBODIMENTS OF THE INVENTION

Figure 1:
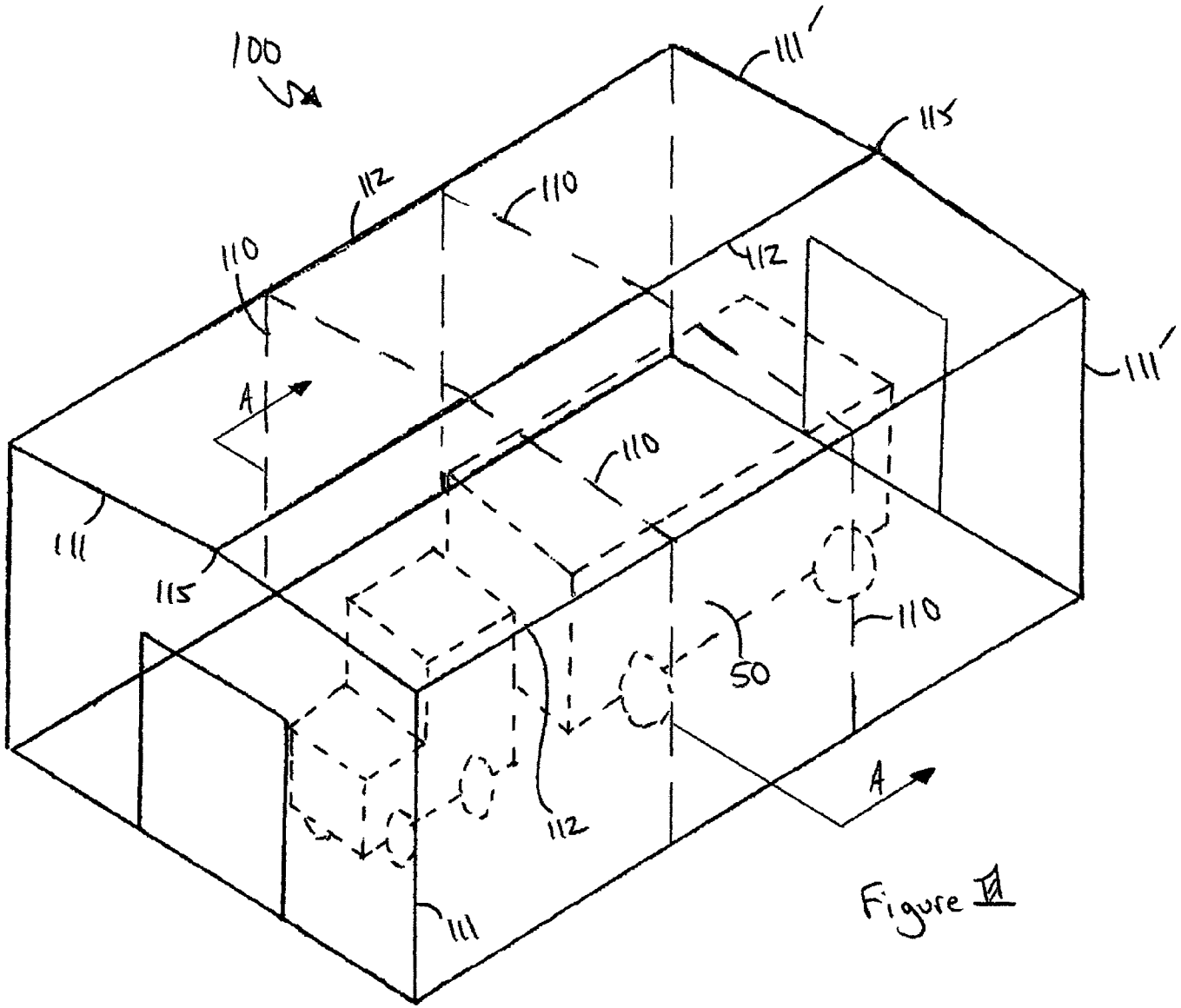
FIG. 1 shows a top perspective view of a basic building structure.

For the purpose of promoting an understanding of the present invention, references are made in the text hereof to embodiments of a basic building structure used to apply a cover over a load positioned on a large object, only some of which are illustrated in the drawings. It is nevertheless understood that no limitations to the scope of the invention are thereby intended. One of ordinary skill in the art will readily appreciate that modifications such as these involving the shape of the building structure, the size and number of supports in the building structure, the materials used, and the placement of the various components do not depart from the spirit and scope of the present invention. Some of these possible modifications are mentioned and described in the following description. Moreover, the reader will note that in the embodiments depicted, like reference numerals refer to identical structural elements in the various figures.

FIG. 1 shows a top perspective view of one embodiment of a basic building structure 100. Structure 100 is used to cover truck 50 with a tarp (as will be discussed in detail infra), but can also be used to cover other large objects such as rail cars. In the embodiment shown, structure has four (4) frames, front frame 111, rear frame 111', and two (2) frames 110 positioned between front frame 111 and rear frame 111'. Each frame, 111, 110, 111' are connected to one another by purlins 112. As can also be seen, structure 100 also comes to a peak at 115 so that the roof positioned thereon (not shown) is angled.

Figure 2A:
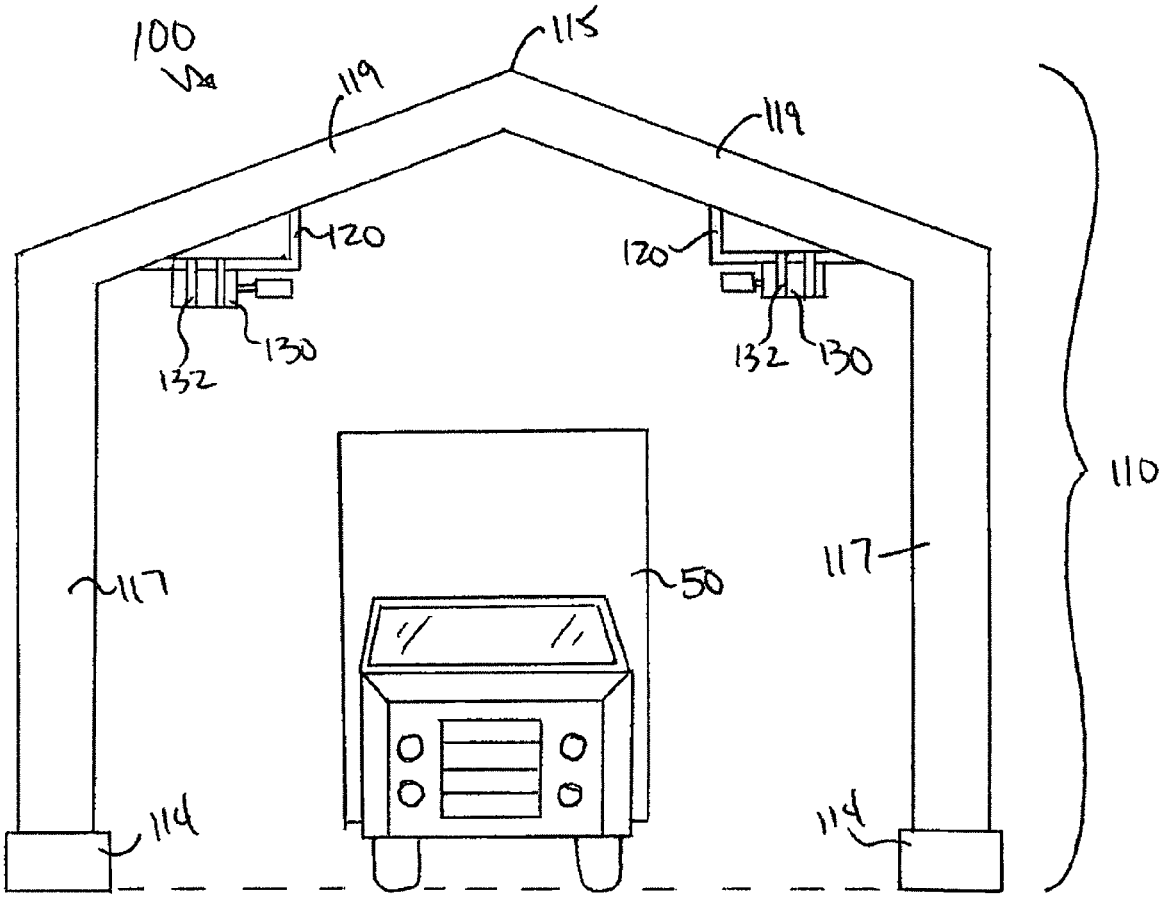
FIG. 2*a* shows a front view of one frame of the basic building structure taken along line A-A of FIG. 1.

FIG. 2*a* shows a front view of one frame 110 of the basic building structure 100 taken along line A-A of FIG. 1, comprised of two (2) vertical members 117 and two slightly angled horizontal members 119. Each vertical member 117 and each horizontal member 119 of frame 110 is, in the embodiment shown, an I-beam made of steel, but one of ordinary skill in the art will recognize that frame 110 could be made of alternate materials or in alternate forms depending on the particular use and according to sound engineering principles. In the embodiment shown, each vertical member 117 of frame 110 is also mounted to concrete pier 114 for increased stability.

Frame 110 could be part of an existing building, retro-fitted for use with the invention of the instant application, or a building could be constructed specifically for use with tarp coverings, with each frame 110 being positioned for structural support of the building as well as for use in covering truck 50 or other large object with a covering.

Mounted to each horizontal member 119 of frame 110 is motor 130. In the embodiment shown, two (2) brackets 120 are secured to the underside of horizontal member 119 of frame 110, and one (1) motor 130 is secured to each bracket 120 using two (2) fasteners 132. However, this is only exemplary and motor(s) 130 could be mounted, permanently or non-permanently, to horizontal member 119 by any means known in the art.

Figure 2B:
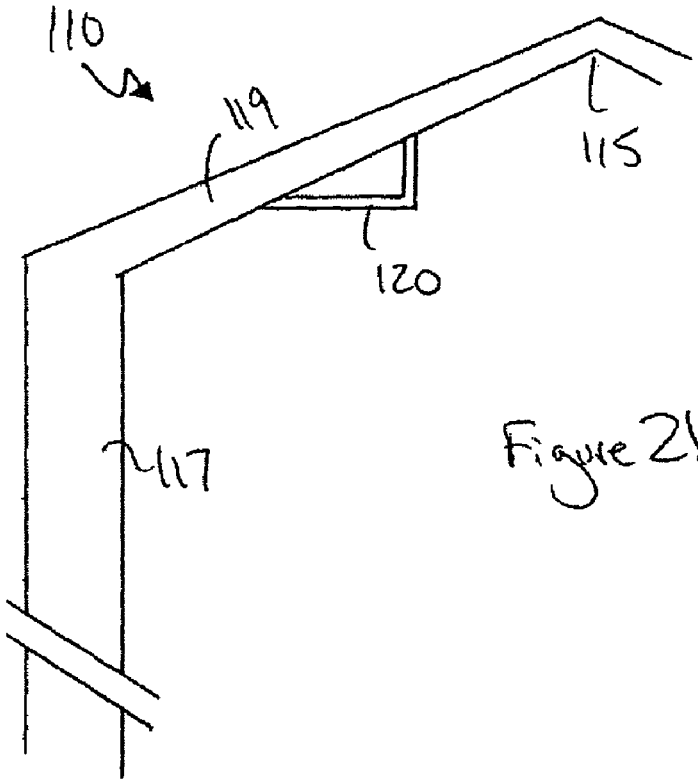
FIGS. 2*b* and 2*c* show portions of alternate embodiments of the frame shown in FIG. 2*a*.
Figure 2C:
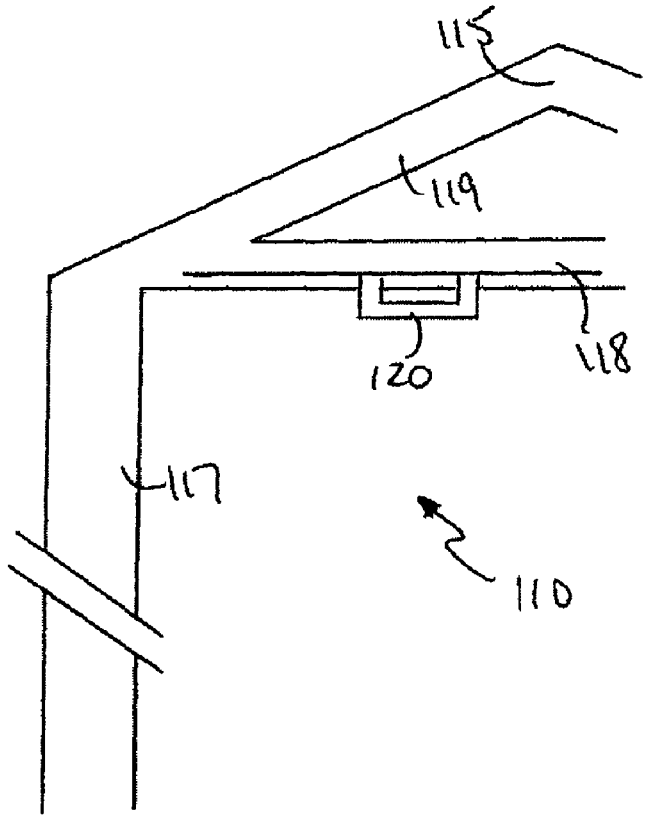
Figure 2D:
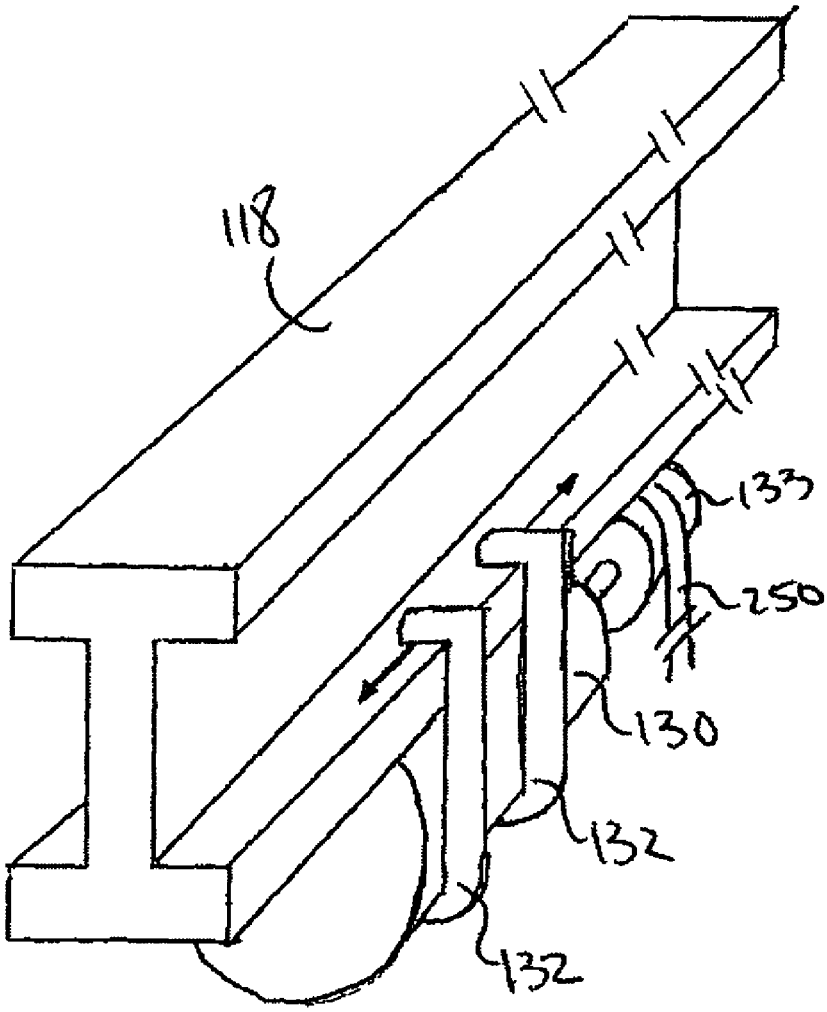
FIG. 2*d* shows a top perspective view of one embodiment of the motor secured to the frame.
Figure 7D:
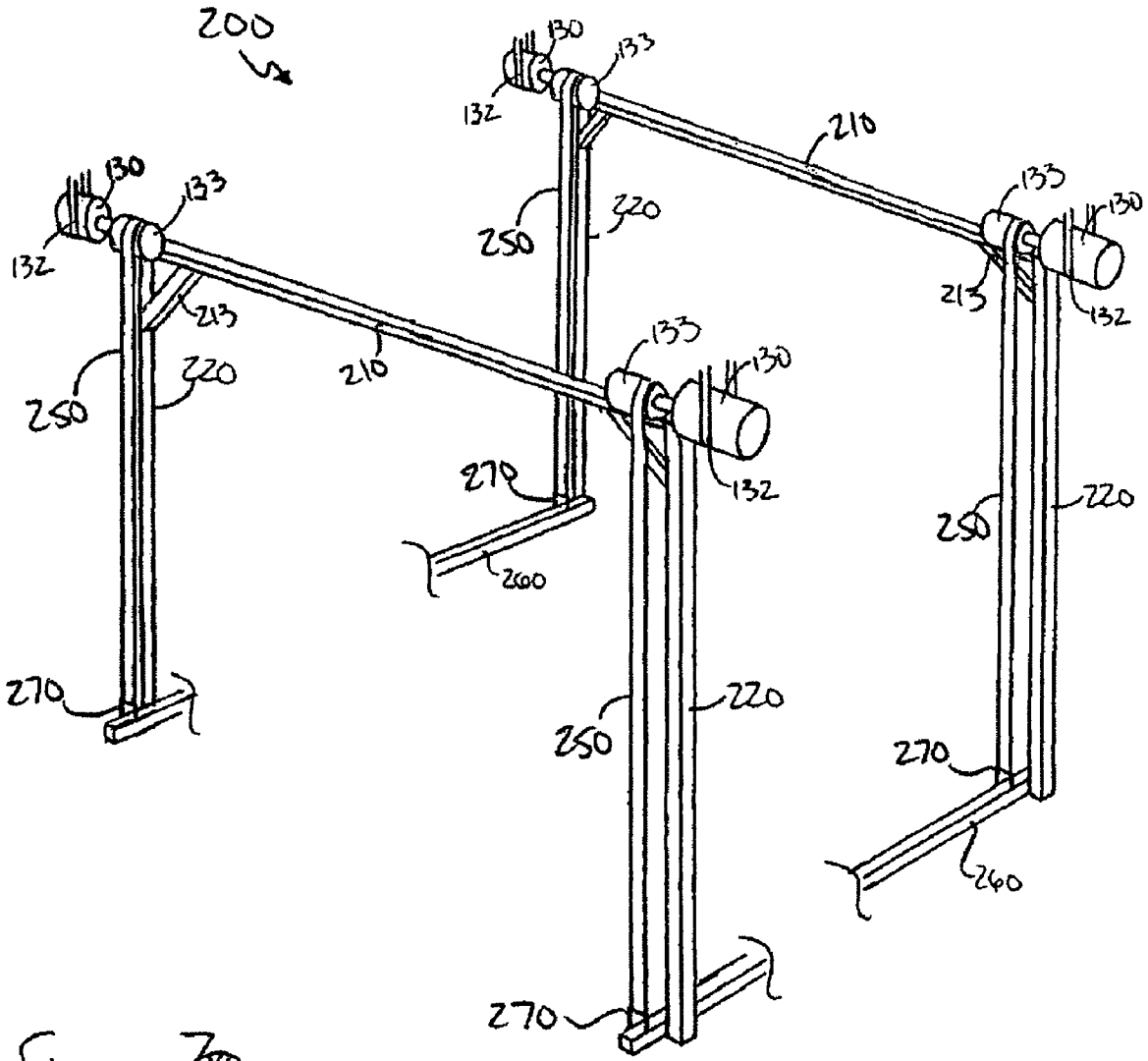
FIG. 7 shows a top perspective view of a plurality of one embodiment of fastening roller members mounted to one arm in the open position.

FIGS. 2*b* and 2*c* show alternate embodiments of frame 110 shown in FIG. 2*a*, as well as brackets 120. In FIG. 2*b*, each horizontal member 119 of frame 110 tapers as it approaches peak 115. That is, each horizontal member 119 is larger at the end that abuts vertical member 117 as compared to the end that abuts the other horizontal member 119 at peak 115. In FIG. 2*c*, frame 110 is further comprised of second horizontal member 118 which extends between the two (2) vertical members 117. This particular embodiment of frame 110 is particularly advantageous in that brackets 120 can be suspended from second horizontal member 118 such that they are translatable along the length of horizontal member 118. This allows each motor (not shown) to be re-positioned along horizontal member 118. For example, each bracket 120 can be moved to the left or to the right to cover a truck or other large object that is not centered underneath frame 110. In addition, each bracket 120 (and motor, not shown) can be moved inward or outward. This allows the tarp loading structure to be used on a truck or other large object of varying widths. FIG. 2*d* shows one embodiment of a translatable bracket which can be moved laterally along horizontal member 118 using fasteners 132. In an alternate embodiment, the translatable bracket can further include a locking mechanism to prevent it from moving along horizontal member 118 during use of same to cover a truck or other large object. The translatable bracket can also be used in the embodiments of frame 110 shown in FIGS. 2*a* and 2*b*. However, if used in these embodiments, the translation of brackets 120 should be equidistantly outward or inward relative to peak 115. Otherwise, one bracket 120 would be higher than the other and proper operation of the tarp loading structure will be adversely affected. In addition, although not shown, additional purlins can be positioned between each frame 110, allowing bracket 120 and or fasteners 132 to move longitudinally as well.

FIG. 3*a* shows a top perspective view of one embodiment of arm lifting structure 200. Arm lifting structure 200 is suspended from two frames (not shown), and the two halves work together to simultaneously raise and lower arms 260, as will be discussed immediately infra.

In the embodiment of arm lifting structure 200 shown in FIG. 3*a*, secured to all four (4) corners of arm lifting structure 200 is gear motor 130, each gear motor 130 having one (1) spool 133 extending therefrom. Each spool 133 is mechanically connected to one (1) lifting connector 250 that extends downward to arms 260 through the use of lifting U-hooks 270. In the embodiment shown, lifting connectors 250 are straps, but can, alternatively, be chains, ropes, cable, link belt, or any other flexible material capable of lifting the weight involved. In addition, lifting connectors 250 could be secured to arms 260 using a mechanism other than U-hooks 270.

Figure 3B:
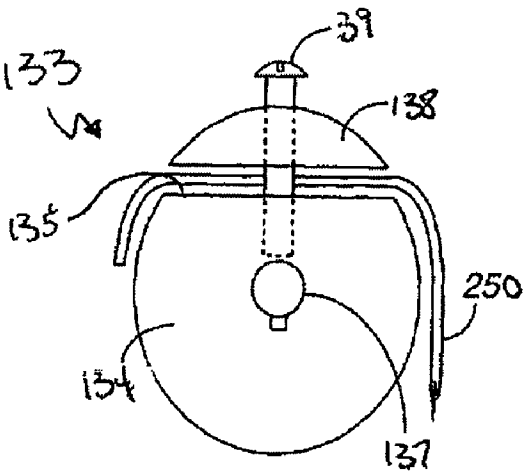
FIGS. 3*b* and 3*c* show a side view and a side perspective view, respectively, of one mechanism by which the lifting connector is secured to the spool.
Figure 3C:
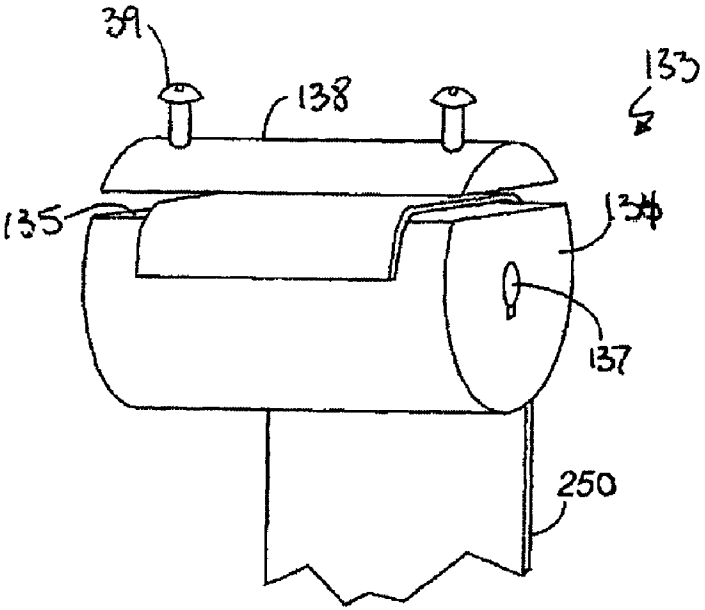

Arms 260 are lifted when spools 133 are rotated and lifting connectors 250 wrap around spools 133. FIGS. 3*b* and 3*c* show a side view and a side perspective view, respectively, of one mechanism by which lifting connector 250 is secured to spool 133. Spool 133 is comprised of first portion 134 having flat side 135 and also having hole 137 through which spool 133 is mechanically connected to a motor (not shown). One end of lifting connector 250 is laid over flat side 135 of spool 133 and secured by spool attachment member 138 that is placed on top of lifting connector 250. Spool attachment member 138 is fixedly secured to first portion 134 of spool 133 such that it will not tear, pierce or puncture lifting connector 250. In the embodiment shown, two screws 39 on opposite ends of spool attachment member 138 are screwed into first portion. As spool 133 rotates, lifting connector 250 is wound around spool 133 and smoothly lifts the arms (not shown). In another embodiment, spool 133 can also have two additional circular protective members attached to the ends of spool 133 to insure that lifting connector 250 does not move in a side to side fashion.

Referring still to FIG. 3*a*, guides 220 and beams 210, collectively referred to as an "arm alignment mechanism," keep arms 260 from moving inward due to the weight of the tarp (not shown). While the embodiment of arm lifting structure 200 shows both guides 220 and beams 210 as the arm alignment mechanism, not all three (3) are necessary, and one of ordinary skill in the art will recognize that fewer components such as just guides 220, just beams 210, guides 220 with a single beam 210, another arm alignment mechanism, and combinations thereof could also be employed depending on the operational requirements of the tarp loading structure. In the embodiment shown in FIG. 3*a*, arm lifting structure 200 further includes supports 213 at each corner between each beam 210 and guides 220 to provide greater strength and stability. However, fewer than four (4) guides 220 could be used, including zero (0) guides. In the embodiments of structure 100 in which the position of motors 130 are adjustable, i.e., as described supra with respect to FIGS. 2*a*, 2*b*, and 2*c*, the positioning of vertical guides 220 should also be adjustable.

Each motor 130 is electrically connected to one another so that one control can be used to uniformly operate all four (4) motors 130 at the same speed so as to allow smooth and simultaneous lifting of arms 260. In the embodiment shown, motors 130 are 1.5 HP gear motors, operating at 47 RPM, model number SK 22-90 S/L, as manufactured by the Nord Gear Corporation™.

In this embodiment, there are four (4) motors 130 mounted to the four corners of arm lifting structure 200 and arm lifting structure 200 is suspended from two (2) frames (not shown) by fasteners 132. In the embodiments shown in FIGS. 2*a* and 2*d*, each motor 130 is secured to the frame by two (2) fasteners 132. In the embodiment of arm lifting structure 200 shown in FIG. 3*a*, only a single fastener 132 is used for each motor 130. One of ordinary skill in the art will appreciate that any number of fasteners can be employed depending on the weight to be supported, including means other than fasteners as shown.

In a further alternate embodiment, the four (4) motors 130 could alternately be supported by beams 210 and arm lifting structure 200 could instead be suspended from the frames by beams 210.

In an alternate embodiment of arm lifting structure 200, fewer than four (4) motors 130 can be employed. For example, two (2) motors 130 could be employed, each motor 130 rotating two (2) spools 133 (see for example, FIG. 9 and the description of same infra). In such an embodiment, two (2) spools 133 could be connected to one another by any means well-known in the art such that as motor 130 operates, two (2) spools operate to lift arm 260. Motors 130 could be positioned on the same side of arm lifting structure 200 such that one (1) motor lifts both sides of the same arm 260 and the other motor 130 lifts the other arm 260, or such that each motor 130 lifts half of arm each 260. Furthermore, arm lifting structure 200 could employ a single motor 130, which is mechanically connected to and rotates all four (4) spools 130. In the embodiment shown and described in FIG. 3*a*, a single 5 HP motor 130 could also be employed. One of ordinary skill in the art will recognize, however, that the power of the motor chosen will depend on the weight of arm lifting structure 200 as well as the weight of the covering.

Figure 4:
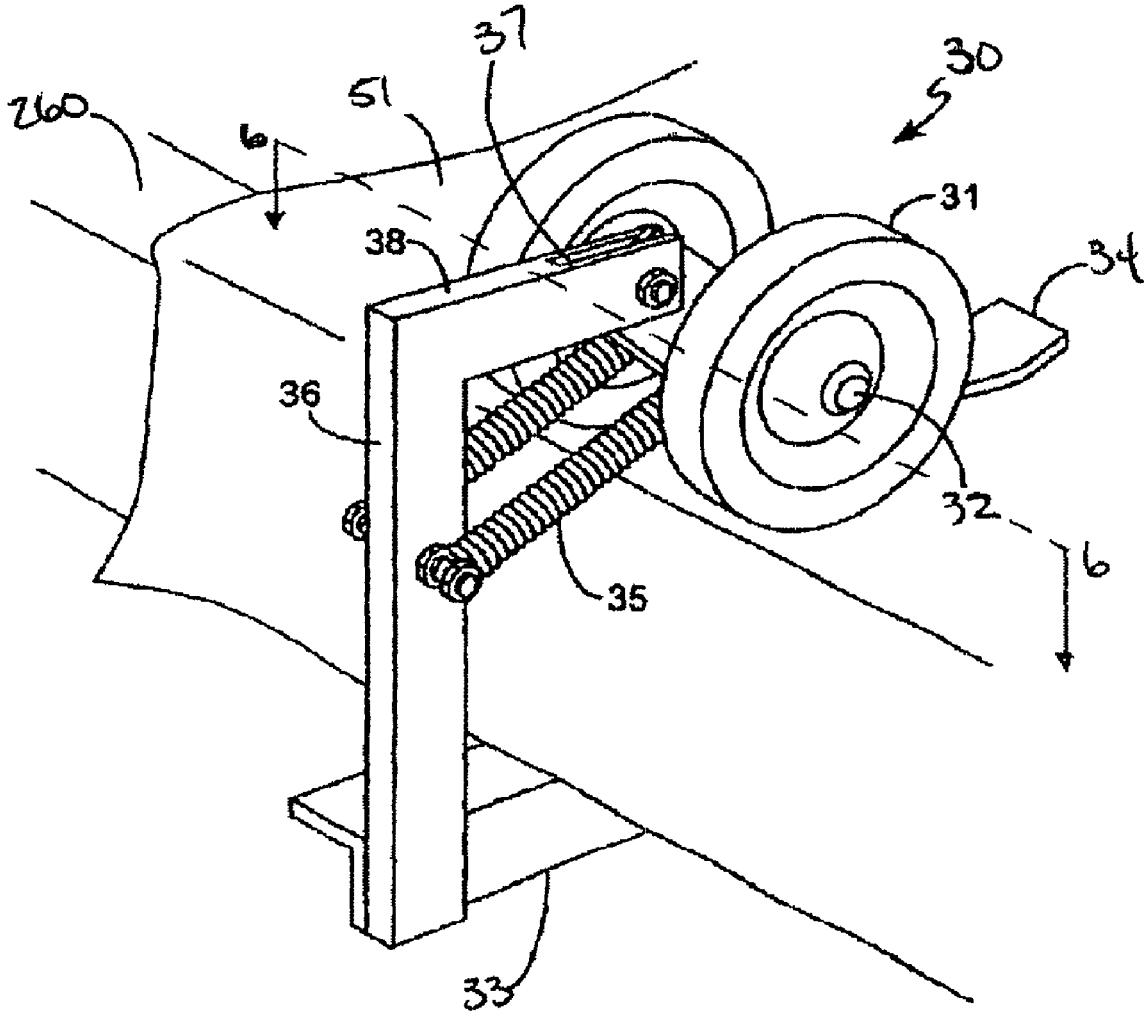
FIG. 4 shows a top perspective view of one fastening roller member securing a covering to one arm.

Secured to each arm 260 is a plurality of fastening roller members 30. FIG. 4 shows a top perspective view of one fastening roller member 30 securing covering 51 to arm 260. In one embodiment, fastening roller member 30 is made of steel tubing. Alternately, it can be made of any other strong metal such as aluminum. Fastening roller member 30 is generally comprised of: vertical support member 36, having a first and second end, first horizontal member 38 fixedly secured to the first end of vertical support member 36, forming a first L-shape, second horizontal member 33 fixedly secured to the second end of vertical support member 36, forming a second L-shape and having a fastening mechanism (not shown, concealed by covering 51) for attaching fastening roller member 30 to arm 26, handle 34 with a rectilinear wall pivotally attached to first horizontal member 38, an axle (not shown, concealed by wheels 31) going through the rectilinear wall, a pair of wheels 31 attached to the axle and ending with cap 32 to secure wheels 31 to the axle, and a pair of tensioners 35 connecting the axle to first horizontal member 38. Tensioners 35 are attached to vertical support member 36 by a screw, bolt, rivets, fastening posts, pins, or any other means on one end and attached to the axle on the other end. In the embodiment shown in FIG. 4, tensioners 35 are a pair of springs. Alternately, tensioners 35 can be electric solenoids, hydraulic cylinders, air cylinders, or any other device commonly known in the art, allowing a more positive control and a tighter grasp of covering 50. Furthermore, this embodiment of fastening roller member 30 shows the use of two (2) wheels 31, but fastening roller member 30 could also be constructed of a single or more than two (2) wheels 31.

Tensioners 35, wheels 31, axle (not visible), and handle 34 form one embodiment of a cover grasping mechanism. As shown in FIG. 4, because of tensioners 35, wheels 31 exert a downward force on covering 50, pinching it between wheels 31 and arm 260 and securing covering 50 in place. Handle 34 is shown in the closed position, which is in a lower position than first horizontal member 38, and is substantially in parallel with first horizontal member 38 and second horizontal member 33. It can also be clearly seen that cover grasping mechanism (tensioners 35, wheels 31, axle (not shown), and handle 30) is positioned below first horizontal member 38.

Figure 5:
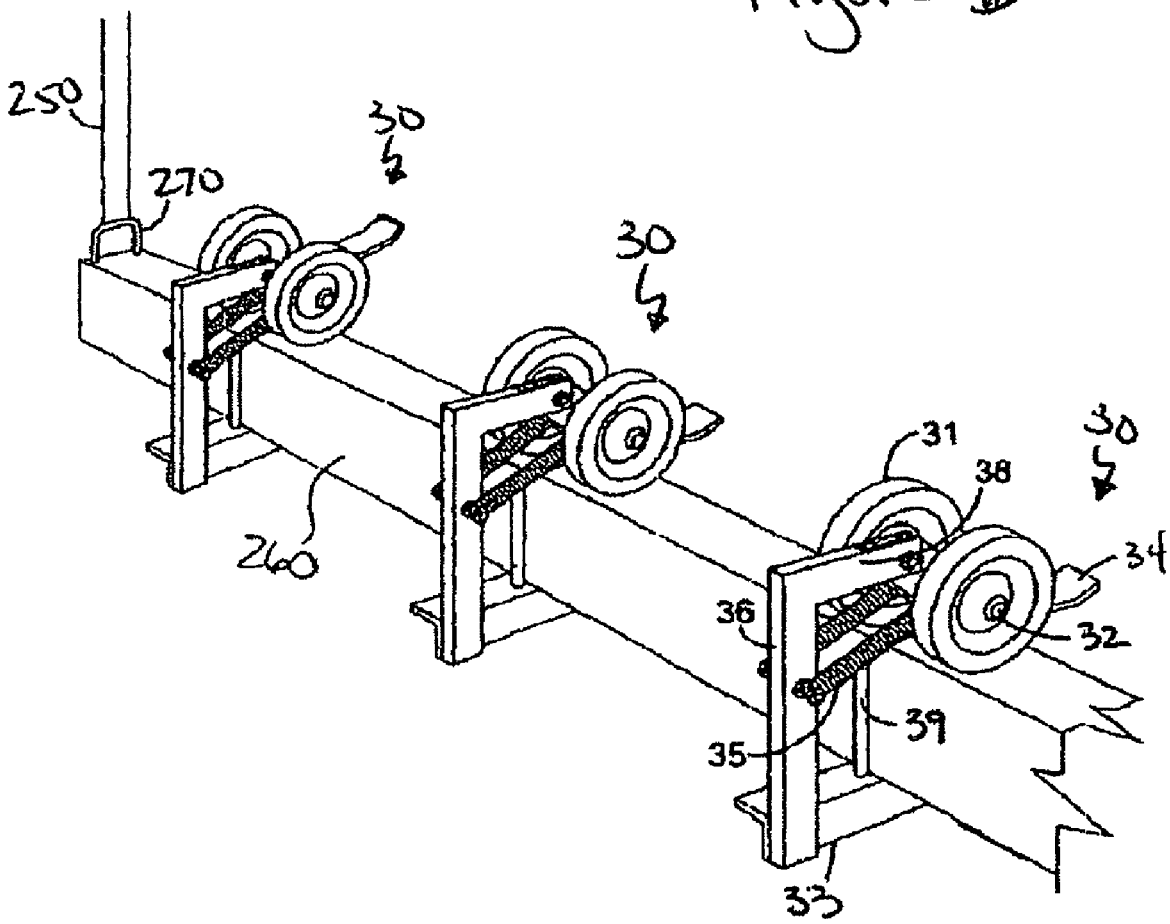
FIG. 5 shows a top perspective view of a plurality of one embodiment of fastening roller members mounted to one arm in the closed position.

FIG. 5 shows a top perspective view of a plurality of one embodiment of fastening roller members 30 mounted to arm 260, and in which most of the same features of fastening roller members 30 can be seen as in FIG. 4. FIG. 5 also shows one lifting connector 250 attached to U-hook 270 which, as described supra, permits arm 260 to be raised and lowered. The lack of a covering allows for a view of fastening mechanism 39. Fastening mechanism 39 wraps around a portion of arm 260 and is secured to second horizontal member 33 (second point of attachment to arm 260 concealed by arm 260). Fastening mechanism 39 can fixedly secure fastening roller member 30 to arm 260 or be such that, when loosened, the device can be slid along arm 260 to adjust for different sizes, shapes, and weights of the tarp or covering. Fastening mechanism 39 also allows for additional fastening roller members 30 to be added to or existing fastening roller members 30 to be removed from arm 260. The number of fastening roller members 30 varies according to the size and material of the covering. The covering can be plastic, cloth, canvas, or any other fabric commonly known in the art for covering truck loads. If the covering is long and/or made of a heavier material, a greater number of fastening roller members 30 may be required than if the covering is short or made of a lighter material.

Fastening mechanism 39 is made of any sound and strong structural material. In one embodiment, fastening mechanism 39 is a U-bolt with the two ends secured to second horizontal member 33 and wrapping around arm 260, but it can be appreciated that other means of attachment known in the art can be used.

Figure 6:
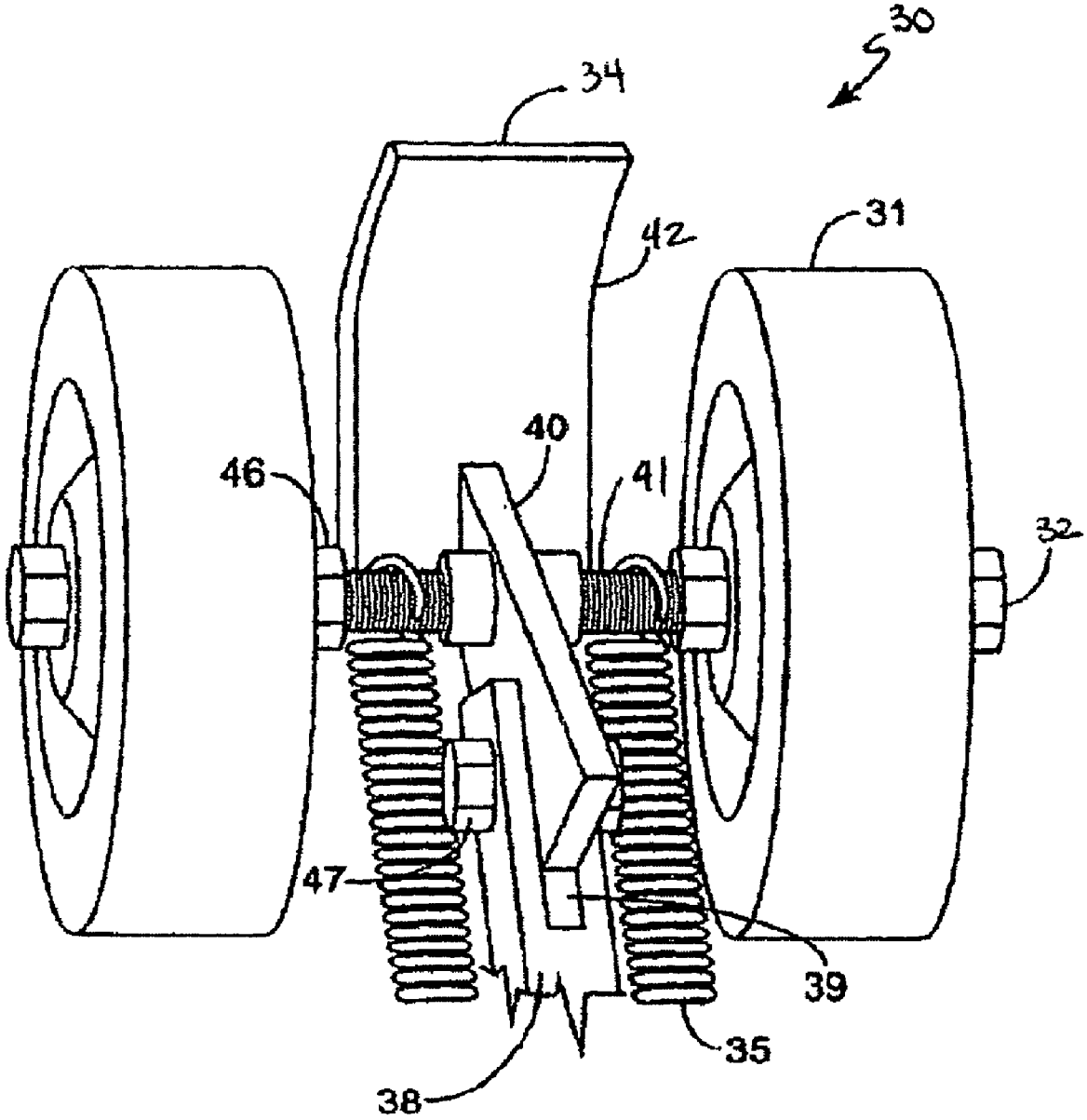
FIG. 6 shows a perspective top view of one embodiment of a fastening roller member taken along line 6-6 of FIG. 4.

FIG. 6 shows a perspective top view of one embodiment of fastening roller member 30, including first horizontal member 38, handle 34, and tensioners 35 taken along line 6-6 of FIG. 4. First horizontal member 38 has slot 37 at the end away from the vertical support member (not shown). Handle 34 has small rectilinear wall 40 extending perpendicularly from handle 34. In this embodiment, handle 34 is elongated with a slight curve at tip 42. In another embodiment, handle 34 and rectilinear wall 40 are one contiguous piece. Axle 41 passes through rectilinear wall 40 with wheels 31 and cap 32 attached to it. Tensioners 35 are attached to axle 41 on one end and to the vertical support member on the other end. Tensioners 35 pull axle 41 and wheels 31 downward towards the arm (not shown), holding the covering (not shown) between wheels 31 and the arm. The pressure exerted by wheels 31 against arm is sufficient to hold the cover in place, but still allows removal of the cover with a pull or tug by an operator.

Figure 7:
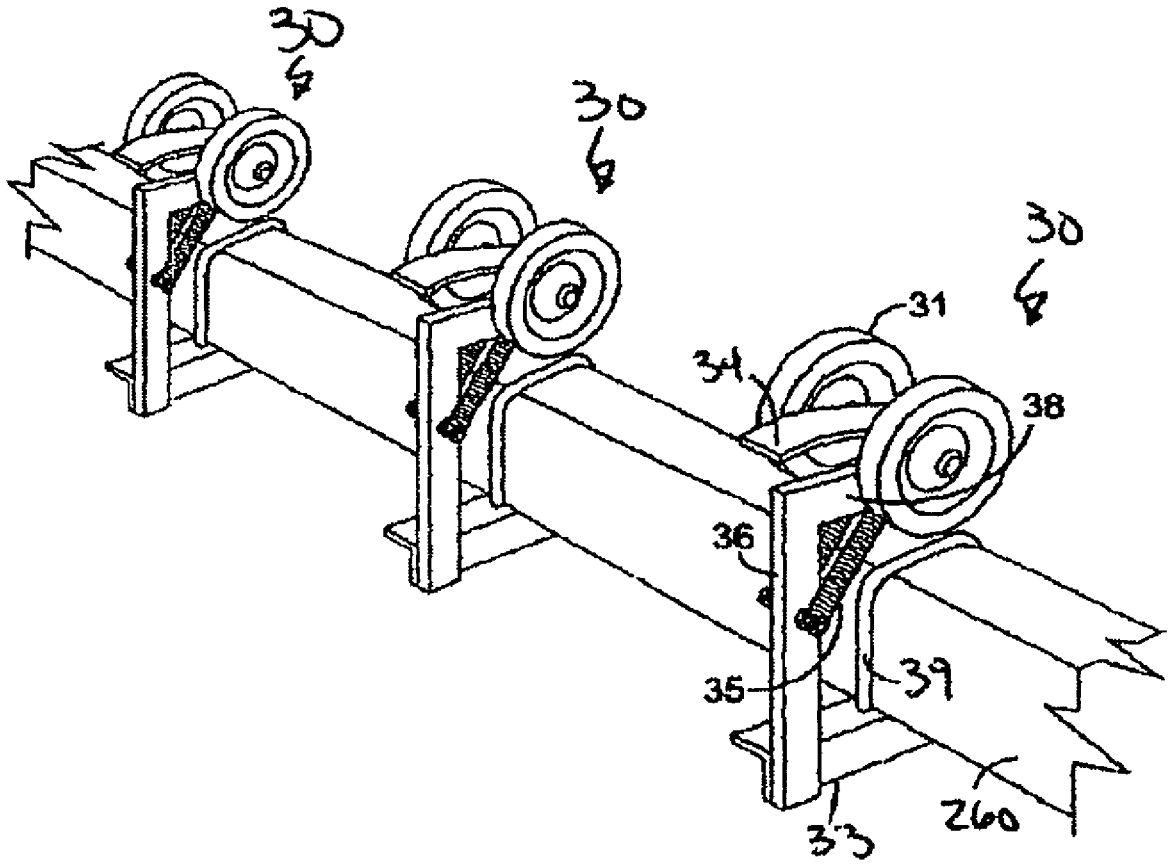

As compared to FIG. 5 in which a plurality of one embodiment of fastening roller members 30 is shown mounted to arm 260 in the closed position, FIG. 7 shows a top perspective view of a plurality of one embodiment of fastening roller members 30 mounted to arm 260 in the open position, also with no tarp or covering secured thereto. As can be appreciated by viewing FIGS. 6 and 7 simultaneously, when moved to the open position, handle 34, axle 41, wheels 31, and rectilinear wall 40 pivot around pivot bolt 47 such that cover grasping mechanism (tensioners 35, wheels 31, axle 41, and handle 34) is above first horizontal member 38. Tensioners 35 stretch to allow rotation around pivot bolt 47 and then pull axle 37 and wheels 31 toward vertical support member 38 and away from arm 260, holding wheels 31 in a lifted position to leave space between wheels 31 and arm 260 to manipulate the covering. It can further be appreciated that when fastening roller member 30 is in the open position, handle 34 extends in an opposite direction from axle 41, though still generally parallel to first horizontal member 38 and second horizontal member 33.

Figure 8A:
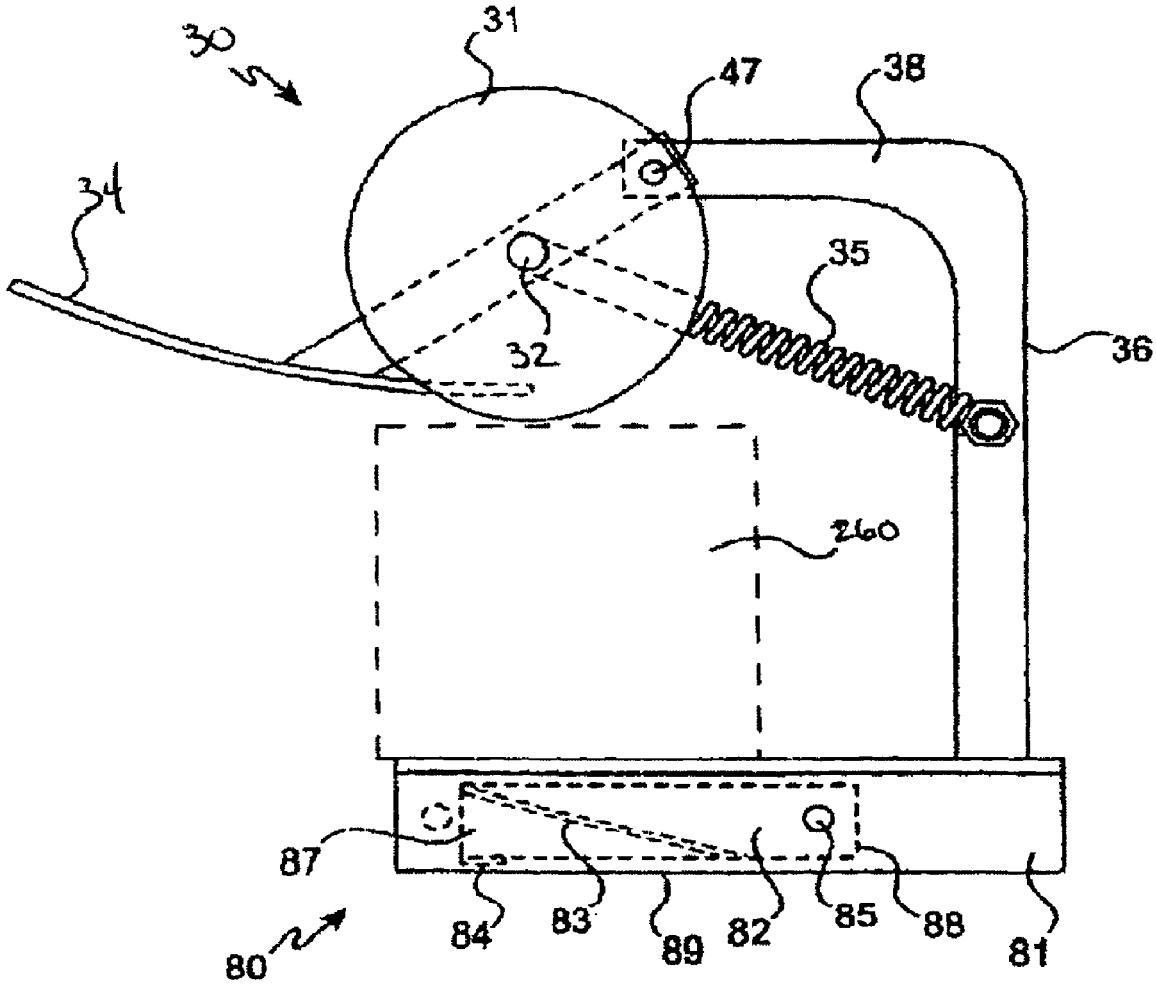
FIG. 8*a* shows a cross-sectional view of an alternate embodiment of a fastening roller member.
Figure 8B:
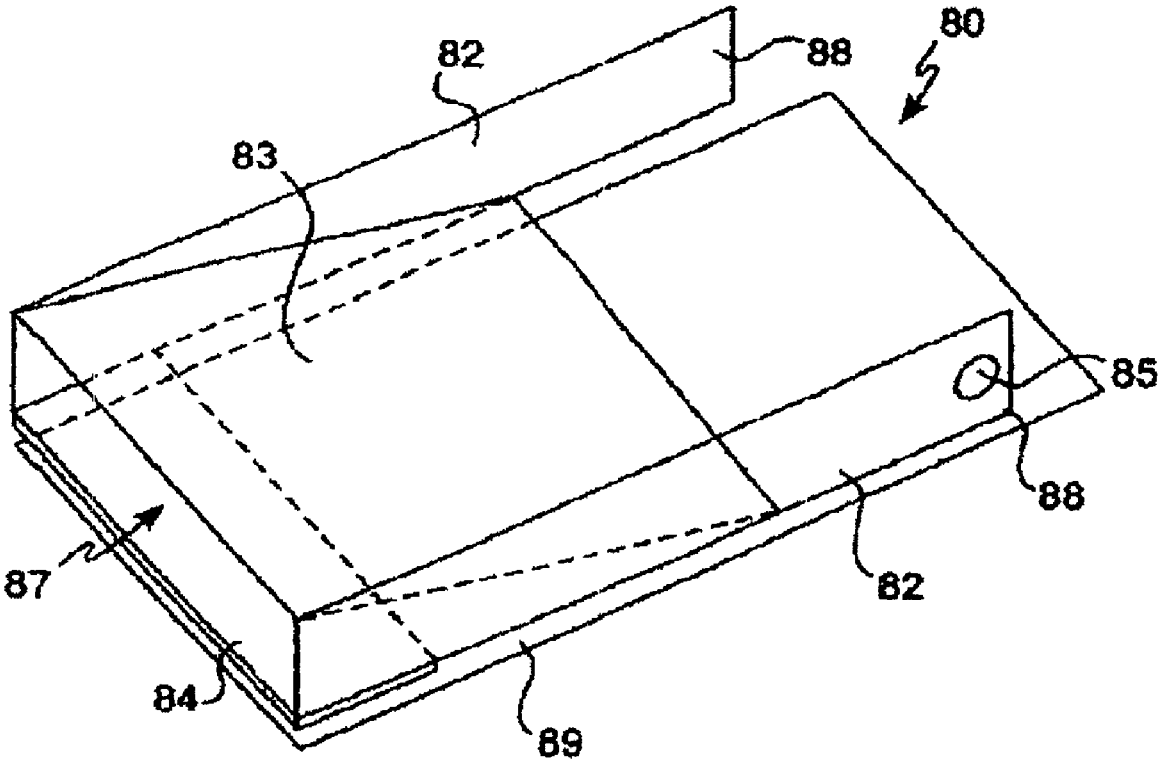
FIG. 8*b* shows a top perspective view of the quick release hanger shown in FIG. 8*a*.

FIG. 8*a* shows a cross-sectional view of an alternate embodiment of fastening roller member 30 in which fastening roller members 30 further includes quick release hanger 80. FIG. 8B shows a top perspective of just quick release hanger 80. FIGS. 8*a* and 8*b* will be referred to simultaneously to describe quick release hanger 80, which is particularly useful when the tarp to be placed on a vehicle is shorter than the width of the truck tarp loading apparatus, making the use of quick release hanger 80 and support straps (not shown) necessary. In such a case, straps are connected on a first end to a first arm (not visible) and then on a second end to quick release hanger 80. The tarp is then laid over the straps. Quick release hanger 80 can also be used in addition to fastening roller member 30 for additional support of the tarp to be loaded.

Quick release hanger 80 is comprised of base member 89, side members 81 (shown only in FIG. 8*a*), angled plate 83, cross plate 84, and two side plates 82. Angled plate 83 and cross plate 84 form opening 87 therebetween. Side plates 82, which pivot about pivot 85, functionally engage side members 81, which functionally engages arm 260, one (1) side plate 82 being on one (1) side of vertical support member 36 and the second side plate 82 being on the other side such that quick release hanger 80 straddles fastening roller member 30.

The first end of the strap (not shown) is secured to the first arm (not shown), and the second end of the strap is loaded through opening 87, under angled plate 83 and above cross plate 84. The strap must pass beyond the lowermost point of angled plate 83. Angled plate 83 helps guide the strap into the proper location, but also holds the strap in place when the strap is engaged. As the weight of the strap pushes down on cross plate 84, quick release hanger 80 pivots around pivot 85. As side plates 82 and angled plate 83 rotate, the lowermost point of angled plate 83 moves downward, pinching the strap between angled plates 83 and base member 89. The greater the weight of the strap, with or without the tarp loaded thereon, the greater the downward force of cross plate 84 and the greater the pinching force of angled plate 83 on the tarp. Also, when arms 260 are lowered, and as the straps and tarp engage the cargo on the vehicle to be covered, the straps exert an upward force on angled plate 83. Side plates 82 and angled plate 83 pivot upward, automatically releasing the straps.

Figure 9:
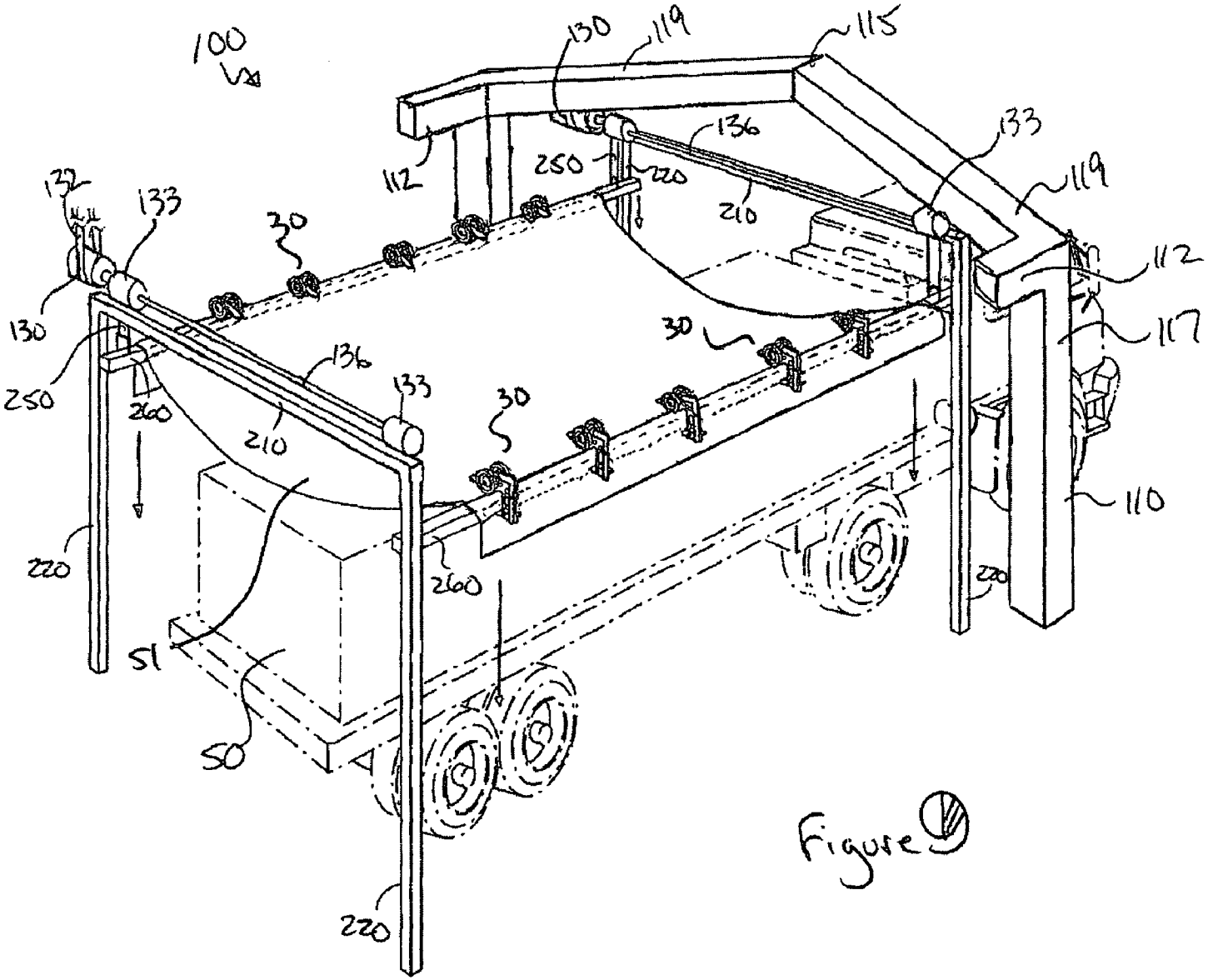
FIG. 9 shows a top perspective view of one embodiment of structure 100.

FIG. 9 shows a top perspective view of one embodiment of the entire structure 100. Frame 110 (only one shown for ease of viewing the remainder of the figure), vertical members 117, horizontal members 119, and peak 115 of frame 110, as well as a portion of purlins 112 connecting the two (2) frames 110 can all be appreciated, though frame 110 does not have any concrete piers and the brackets supporting motors 130 cannot be seen from this perspective. In the embodiment shown, as discussed supra, there are two (2) motors 133 and four (4) spools 133. Each motor 130 drives two (2) spools via connection rod 136. As motors 130 operate, spools 133 rotate, lifting connector 250 winds or unwinds on spools 133, and arms 260 raise or lower, as described in detail supra. Motors 130 are, in this embodiment, suspended from frame 110. The embodiment shown also includes both guides 220 and two (2) beams 210, collectively acting as the arm alignment mechanism to ensure that arms 260 raise and lower straight up and down. The embodiment of structure 100 further includes ten (10) fastening roller members 30, five (5) on each arm 260. Covering 51 is secured to arms 260 by fastening roller members 30 and raised above the height of loaded truck 50 to be covered. As motors 130 are operated, arms 260 descend, covering 51 is disposed on truck 50, where it can be secured to truck by any conventional means.

Figure 10:
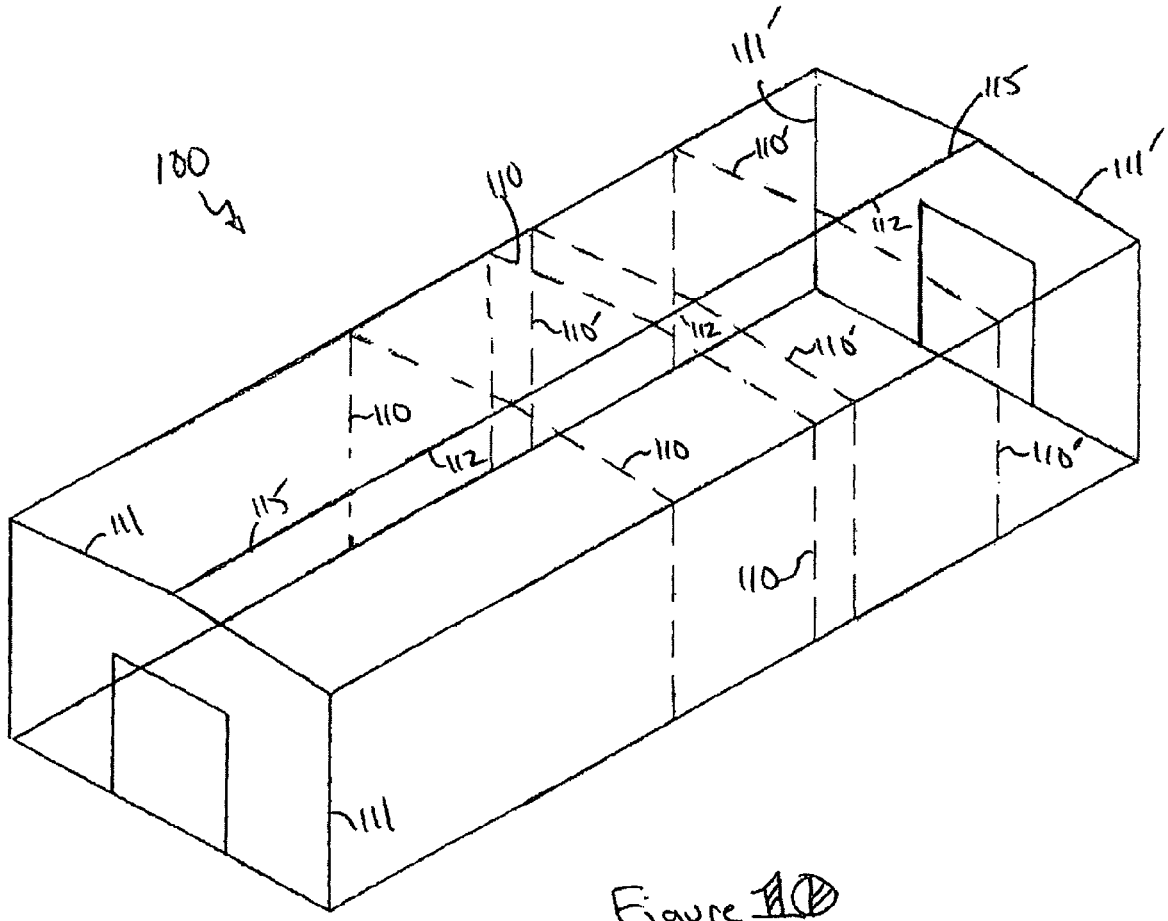
FIG. 10 shows a top perspective view of one alternate embodiment of a basic building structure in which two structures are in series.

FIG. 10 shows a top perspective view of an alternate embodiment of basic structure 100 in which two (2) structures 100 are in series. The entire previous discussion is applicable to this embodiment of building structure 100 in which structure 100 is used to cover truck 50 or other large objects with a covering. In the embodiment shown, structure has six (6) frames: front frame 111, rear frame 111', and four (4) mid frames 110 and 110'. There are two (2) arm lifting structures (not shown) suspended from structure 100; one arm lifting structure suspended from the forward two (2) frames 110 and one arm lifting structure suspended from the rear two (2) frames 110'. As with the embodiment shown and described in FIG. 1, each frame, 111, 110, 110', and 111' is connected to one another by purlins 112. As can also be seen, structure 100 also comes to a peak at 115 so that the roof (not shown) is angled. The advantage of such a construction is that a particularly long truck or rail car (not shown) can have two coverings secured to it at once and without having to move the truck or rail car to apply the second covering.

Although the invention is described with reference to specific embodiments, it should be obvious to one skilled in the art that variations to the structure or its various components can be made without departing from the spirit and scope of the invention as claimed, or, if the two (2) structures 100 are in series and spaced far enough apart, two (2) large objects could be covered at the same time.

What is claimed is:

1. A tarp-loading building structure comprising:

a building;

a plurality of frames;

at least one motor supported by at least one of said plurality of frames;

a plurality of spools, each of said plurality of spools mechanically engaging said at least one motor; and an arm lifting structure supported by said plurality of frames, said arm lifting structure comprising:

a plurality of arms;

a plurality of lifting connectors, each of said plurality of lifting connectors secured on one end to one end of one of said plurality of arms and secured on a second end to one of said plurality of spools; and at least one fastening roller member mounted to said plurality of arms for non-permanently securing a covering to said arm lifting structure;

wherein as said at least one motor is operated, each of said plurality of spools rotates to raise or lower said plurality of arms; and wherein the plurality of frames provide structural support of the building as well as being for use in applying a covering to a large object, wherein said at least one fastening roller member is comprised of:

a vertical support member, having a first end and a second end;

a first horizontal member fixedly secured to said first end of said vertical support member, forming an L shape with said vertical support member and having portions forming a slot;

a second horizontal member fixedly secured to said second end of said vertical support member, forming an L shape with said vertical support member;

a fastening mechanism for attaching said one or more fastening roller members to said plurality of arms; and a cover grasping mechanism, wherein each of said at least one fastening roller member is further comprised of a quick release hanger, said quick release hanger comprised of:

a base member;

two side members;

an angled plate;

a cross plate; and two side plates, wherein said angled plate and said cross plate form an opening therebetween to receive a strap, and each of said two side plates functionally engage said two side members and pivot about a pivot to non-permanently secure said strap within said quick release hanger.

2. The structure of claim 1, wherein each of said at least one motor is movable along one of said plurality of frames or along a purlin between two of said plurality of frames to change a lateral dimension or a longitudinal dimension of said arm lifting structure.

3. The structure of claim 1, wherein said arm lifting structure further includes an arm alignment mechanism to ensure that each of said plurality of arms is raised and lowered generally straight up and down.

4. The structure of claim 3, wherein said arm alignment mechanism is selected from a group comprised of at least one guide, at least one beam, and combinations thereof.

5. The structure of claim 1, wherein said large object is selected from a group comprising a loaded bed of a truck and a rail car and wherein said covering is made of a material selected from a group comprising plastic, canvas, and cloth.

6. The structure of claim 1, wherein said structure further comprises a second arm lifting structure supported by said plurality of frames, said second arm lifting structure positioned in series behind said arm lifting structure to load a second covering on a large object.

7. A building structure for covering a large object with a cover comprising:

a building structure;

a plurality of frames, each of said plurality of frames being part of the building structure;

at least one motor suspended from at least one of said plurality of frames;

a plurality of spools, each of said plurality of spools mechanically engaging said at least one motor; and an arm lifting structure suspended from said plurality of frames, said arm lifting structure comprising:

a first arm and a second arm;

a first lifting connector, a second lifting connector, a third lifting connector, and a fourth lifting connector, said first lifting connector secured on a first end to a first end of said first arm and on a second end to one of said plurality of spools, said second lifting connector secured on a first end to a second end of said first arm and on a second end to one of said plurality of spools, said third lifting connector secured on a first end to a first end of said second arm and on a second end to one of said plurality of spools, and said fourth lifting connector secured on a first end to a second end of said second arm and on a second end to one of said plurality of spools; and at least one fastening roller member mounted to each of said first arm and said second arm for non-permanently securing said cover to said arm lifting structure;

wherein as said at least one motor is operated, each of said plurality of spools rotates to raise or lower said first arm, said second arm, and said cover; and wherein the plurality of frames provide structural support of the building as well as being for use in applying a covering to a large object, wherein said at least one motor is a first motor and a second motor, said first motor mechanically connected to a first spool of said plurality of spools and said first spool is mechanically connected to a second spool of said plurality of spools such that said first motor drives said first spool and said second spool, and said second motor is mechanically connected to a third spool of said plurality of spools and said third spool is mechanically connected to a fourth spool of said plurality of spools such that said second motor drives said third spool and said fourth spool, wherein said first motor and said second motor are electronically connected to each other so that said first motor and said second motor operate simultaneously, wherein each of said at least one fastening roller member is further comprised of a quick release hanger, said quick release hanger comprised of:

a base member;

two side members;

an angled plate;

a cross plate; and two side plates, wherein said angled plate and said cross plate form an opening therebetween to receive a strap, and each of said two side plates functionally engage said two side members and pivot about a pivot to non-permanently secure said strap within said quick release hanger.

8. The structure of claim 7, wherein each of said at least one motor is movable along one of said plurality of frames or along a purlin between two of said plurality of frames.

9. The structure of claim 7, wherein said arm lifting structure further includes an arm alignment mechanism to ensure that said first arm and said second arm are raised and lowered generally straight up and down, said arm alignment mechanism is selected from a group comprised of at least one guide, at least one beam, and combinations thereof.

10. The structure of claim 7, wherein said large object is selected from a group comprising a loaded bed of a truck and a rail car and wherein said cover is made of a material selected from a group comprising plastic, canvas, and cloth.

11. The structure of claim 7, wherein said structure further comprises a second arm lifting structure suspended from said plurality of frames, said second arm lifting structure positioned in series behind said arm lifting structure to load a second covering on a large object.

12. An apparatus comprising:

a building;

a plurality of frames;

at least one motor suspended from at least one of said plurality of frames;

a plurality of spools, each of said plurality of spools mechanically engaging said at least one motor;

an arm lifting structure supported by said plurality of frames, said arm lifting structure comprising:

a plurality of arms;

a plurality of lifting connectors, each of said plurality of lifting connectors secured on one end to one end of one of said plurality of arms and secured on a second end to one of said plurality of spools; and at least one fastening roller member mounted to said plurality of arms for non-permanently securing a covering to said arm lifting structure;

wherein as said at least one motor is operated, each of said plurality of spools rotates to raise or lower said plurality of arms; and an arm alignment mechanism to ensure that each of said plurality of arms is raised and lowered generally straight up and down, wherein said arm alignment mechanism is selected from a group comprised of at least one guide, at least one beam, and combinations thereof; and wherein the plurality of frames provide structural support of the building as well as being for use in applying a covering to a large object, wherein said at least one fastening roller member is comprised of:

a vertical support member, having a first end and a second end;

a first horizontal member fixedly secured to said first end of said vertical support member, forming an L shape with said vertical support member and having portions forming a slot;

a second horizontal member fixedly secured to said second end of said vertical support member, forming an L shape with said vertical support member;

a fastening mechanism for attaching said one or more fastening roller members to said plurality of arms; and a cover grasping mechanism, wherein each of said at least one fastening roller member is further comprised of a quick release hanger, said quick release hanger comprised of:

a base member;

two side members;

an angled plate;

a cross plate; and two side plates, wherein said angled plate and said cross plate form an opening therebetween to receive a strap, and each of said two side plates functionally engage said two side members and pivot about a pivot to non-permanently secure said strap within said quick release hanger.

13. The apparatus of claim 12, wherein each of said at least one motor is movable along one of said plurality of frames or along a purlin between two of said plurality of frames to change a lateral dimension or a longitudinal dimension of said arm lifting structure.

14. The apparatus of claim 12, wherein said large object is selected from a group comprising a loaded bed of a truck and a rail car and wherein said covering is made of a material selected from a group comprising plastic, canvas, and cloth.

15. The apparatus of claim 12, wherein said structure further comprises a second arm lifting structure supported by said plurality of frames, said second arm lifting structure positioned in series behind said arm lifting structure to load a second covering on a large object.

16. An apparatus comprising:

a building structure;

a plurality of frames, each of said plurality of frames being part of the building structure;

at least one motor supported by at least one of said plurality of frames, wherein each of said at least one motor is movable along one of said plurality of frames or along a purlin between two of said plurality of frames to change a lateral dimension or a longitudinal dimension of said arm lifting structure;

a plurality of spools, each of said plurality of spools mechanically engaging said at least one motor; and an arm lifting structure supported by said plurality of frames, said arm lifting structure comprising:

a plurality of arms;

a plurality of lifting connectors, each of said plurality of lifting connectors secured on one end to one end of one of said plurality of arms and secured on a second end to one of said plurality of spools; and at least one fastening roller member mounted to said plurality of arms for non-permanently securing a covering to said arm lifting structure;

wherein as said at least one motor is operated, each of said plurality of spools rotates to raise or lower said plurality of arms; and wherein the plurality of frames provide structural support of the building as well as being for use in applying a covering to a large object, wherein said at least one fastening roller member is comprised of:

a vertical support member, having a first end and a second end;

a first horizontal member fixedly secured to said first end of said vertical support member, forming an L shape with said vertical support member and having portions forming a slot;

a second horizontal member fixedly secured to said second end of said vertical support member, forming an L shape with said vertical support member;

a fastening mechanism for attaching said one or more fastening roller members to said plurality of arms; and a cover grasping mechanism, wherein each of said at least one fastening roller member is further comprised of a quick release hanger, said quick release hanger comprised of:

a base member;

two side members;

an angled plate;

a cross plate; and two side plates, wherein said angled plate and said cross plate form an opening therebetween to receive a strap, and each of said two side plates functionally engage said two side members and pivot about a pivot to non-permanently secure said strap within said quick release hanger.

17. The apparatus of claim 16, wherein said arm lifting structure further includes an arm alignment mechanism to ensure that each of said plurality of arms is raised and lowered generally straight up and down, said arm alignment mechanism being selected from a group comprised of at least one guide, at least one beam, and combinations thereof.

18. The apparatus of claim 16, wherein said large object is selected from a group comprising a loaded bed of a truck and a rail car and wherein said covering is made of a material selected from a group comprising plastic, canvas, and cloth.

19. The apparatus of claim 16, wherein said structure further comprises a second arm lifting structure supported by said plurality of frames, said second arm lifting structure positioned in series behind said arm lifting structure to load a second covering on a large object.

20. A tarp-loading structure comprising:

a plurality of frames;

at least one motor supported by at least one of said plurality of frames;

a plurality of spools, each of said plurality of spools mechanically engaging said at least one motor; and an arm lifting structure supported by said plurality of frames, said arm lifting structure comprising:

a plurality of arms;

a plurality of lifting connectors, each of said plurality of lifting connectors secured on one end to one end of one of said plurality of arms and secured on a second end to one of said plurality of spools; and at least one fastening roller member mounted to said plurality of arms for non-permanently securing a covering to said arm lifting structure;

wherein as said at least one motor is operated, each of said plurality of spools rotates to raise or lower said plurality of arms; and wherein the plurality of frames are adapted to provide structural support of the building as well as being for use in applying a covering to a large object; and wherein each of said at least one fastening roller member is further comprised of a quick release hanger, said quick release hanger comprised of:

a base member;

two side members;

an angled plate;

a cross plate; and two side plates, wherein said angled plate and said cross plate form an opening therebetween to receive a strap, and each of said two side plates functionally engage said two side members and pivot about a pivot to non-permanently secure said strap within said quick release hanger.

* * * * *